US012145818B2

(12) United States Patent
Lohner et al.

(10) Patent No.: US 12,145,818 B2
(45) Date of Patent: Nov. 19, 2024

(54) ROLL FEED WITH TUBE ROLL AND SIMPLIFIED MOUNTING/DISMOUNTING

(71) Applicant: Zehnder & Sommer AG, Burgdorf (CH)

(72) Inventors: Erich Lohner, Burgdorf (CH); Urs Fankhauser, Burgdorf (CH)

(73) Assignee: Zehnder & Sommer AG, Burgdorf (CH)

( * ) Notice: Subject to any disclaimer, the term of this patent is extended or adjusted under 35 U.S.C. 154(b) by 80 days.

(21) Appl. No.: 18/176,162

(22) Filed: Feb. 28, 2023

(65) Prior Publication Data

US 2023/0271799 A1 Aug. 31, 2023

(30) Foreign Application Priority Data

Feb. 28, 2022 (DE) ..... 202022000514.8

(51) Int. Cl.
*B65H 5/06* (2006.01)
*B65H 27/00* (2006.01)

(52) U.S. Cl.
CPC ..... *B65H 5/062* (2013.01); *B65H 27/00* (2013.01); *B65H 2404/1141* (2013.01); *B65H 2404/173* (2013.01)

(58) Field of Classification Search
CPC ..... B65H 2601/324; B65H 2404/173; B65H 2404/1141; B65H 27/00; B65H 5/062
See application file for complete search history.

(56) References Cited

U.S. PATENT DOCUMENTS 3,349,981 A 10/1967 Hawkins et al.
4,158,429 A 6/1979 Ohmori
5,044,800 A * 9/1991 Rosenthal ..... B41J 11/04 400/660
5,156,388 A * 10/1992 Morita ..... B65H 3/0669 271/164
5,371,576 A * 12/1994 Gonda ..... G03G 15/751 399/167
5,421,569 A * 6/1995 Davidson ..... G03G 21/1695 271/274
5,983,055 A * 11/1999 Bito ..... G03G 15/757 399/159
6,598,378 B1 * 7/2003 Pottier ..... B65H 27/00 53/556

(Continued)

FOREIGN PATENT DOCUMENTS

AU 2002361231 A1 7/2003
DE 2215342 A1 10/1973

(Continued)

*Primary Examiner* — Jason L Vaughan
(74) *Attorney, Agent, or Firm* — Jason M. Shapiro; Devlin Law Firm LLC

(57) ABSTRACT

A roll feed includes a base body, a first tube roll having a rolling surface and a first bearing shaft, wherein the base body is configured to support the first tube roll and the first bearing shaft. The first bearing shaft and the first tube roll are configured to be detachably connected to each other for a rotationally fixed connection, wherein the base body is configured such that the first tube roll can be removed from the base body in an axial direction, wherein the axial direction is substantially parallel to an axis of rotation of the first tube roll.

25 Claims, 6 Drawing Sheets

(56) References Cited

U.S. PATENT DOCUMENTS

| | | | | |
|---|---|---|---|---|
| 7,209,682 | B2 * | 4/2007 | Numagami | G03G 15/757 399/167 |
| 7,403,733 | B2 * | 7/2008 | Watanabe | G03G 21/1647 399/167 |
| 11,267,666 | B2 * | 3/2022 | Horita | F16D 1/101 |
| 2002/0057928 | A1 * | 5/2002 | Yasumoto | G03G 15/757 399/167 |
| 2007/0029362 | A1 * | 2/2007 | Caillaud | F27D 3/026 226/188 |
| 2014/0084534 | A1 * | 3/2014 | Ichikawa | B65H 3/0638 271/109 |
| 2017/0291730 | A1 * | 10/2017 | Rudolfsson | F16D 1/076 |

FOREIGN PATENT DOCUMENTS

| | | | | |
|---|---|---|---|---|
| DE | 2427768 | A1 | 12/1975 | |
| EP | 1123887 | A1 | 8/2001 | |
| EP | 3974079 | A1 * | 3/2022 | B21D 43/09 |
| FR | 2273606 | A2 | 1/1976 | |
| JP | 11244753 | A * | 9/1999 | B05C 1/08 |
| WO | WO 03/057607 | A1 | 7/2003 | |

* cited by examiner

ROLL FEED WITH TUBE ROLL AND SIMPLIFIED MOUNTING/DISMOUNTING

CROSS REFERENCE TO RELATED APPLICATIONS

This application claims the benefit of priority to German Patent Application No. 20-2022-000514.8, filed on Feb. 28, 2022, the disclosure of which is incorporated by reference herein in its entirety.

FIELD OF THE INVENTION

The present invention relates to a roll feed comprising a base body and at least one tube roll for axial removal from the base body.

BACKGROUND

Roll feeds are used, for example, for conveying and feeding, in particular for the clocked feeding of workpieces, such as band or strip material. For example, roll feeds are used in stamping applications. The workpiece is fed in a clocked manner, wherein the clocking of the feeding is synchronized with a stamping tool.

The principle of roll feeding is based in principle on at least two rolls, of which at least one first roll is arranged on a first side (for example above) the workpiece to be conveyed and a second roll is arranged on an opposite side (for example below) the workpiece to be conveyed. If the roll feed comprises two rolls, these are typically arranged opposite one another. Other arrangements are likewise possible. For example, a roll feed can comprise three rolls (or another number of rolls), wherein the rolls are arranged offset with respect to one another, such that the workpiece is conveyed in a manner of wave movement by the rolls.

At least one of the rolls is a driven roll. For feeding/conveying, the workpiece is introduced into a gap which is formed between the rolls. The workpiece is then fed/conveyed by a synchronous rotation of the rolls. The rotational speed of the rolls determines the conveying or feeding speed.

Conventional rolls typically comprise a roll body to which bearing shafts are attached in a rotationally fixed manner on both sides. The bearing shafts serve to support the roll, to output an output torque and/or to receive a drive torque. Each roll is typically supported separately. A drive shaft of a motor or of a transmission which transmits a drive torque to the roll, or an output shaft which receives an output torque of the roll, has to be supported additionally. In any case, four bearing points thus typically have to be provided for a roll arrangement, for example in the case of clamped tube pieces.

In addition, the manufacture of conventional rolls is complex and expensive since the bearing shafts have to be connected to the roll body in such a way that the two bearing shafts and the roll body are aligned exactly coaxially. The roll body typically has corresponding bearing shaft receptacles which each engage with a corresponding bearing shaft in a form-fitting, form-fitting and adhesive-fitting manner (for example welding) and/or in a form-fitting and force-fitting manner. In order to achieve an exact alignment of the two bearing shafts and of the shaft body, the bearing shaft receptacles and corresponding receiving flanges of the bearing shafts have to be manufactured with high precision and low tolerances. This makes the manufacture expensive and complex. Due to the fixed connection of roll body and bearing shafts, conventional rolls are bulky and simple installation in a roll feed is not possible without disassembling an entire roll feed. In general, many method steps are necessary for manufacturing a conventional roll. The delivery times for conventional rolls are thus long and the number of suppliers is low.

If a roll is damaged, it has to be replaced. Extensive dismantling of the roll feed is often necessary for this purpose. This is associated with undesirably long downtimes of the roll feed.

The following prior art documents may be mentioned by way of example.

Document U.S. Pat. No. 3,349,981 relates to roll rollers for strip-processing machine tools, such as, for example, presses, roll feeds, straightening machines, measuring and feeding devices. The rolls used are solid shafts and therefore heavy and have a plurality of turned-off cylindrical surfaces which are formed, inter alia, as bearing surfaces and form a fixed unit with the roll roller. The roll rollers are provided with spindle ends, on which bearings are arranged. In addition, the roll rollers are arranged in fixed side plates of a roll feed.

Document DE 24 27 768 A1 shows a device for the stepwise feeding of strip material on presses, punching or similar work machines. The rolls are supported on an axle which is arranged fixedly in side walls. Due to this complex arrangement, the entire device has to be disassembled in the event of any exchange of rolls.

U.S. Pat. No. 4,158,429 A relates to a device for feeding sheet material. In particular, the control of the feeding speed of the sheet material is improved in that a simplified change of this speed is made possible. The rolls are here integrated fixedly in side walls ("side frames"), as a result of which simple dismounting of the rolls is prevented.

The following remotely related prior art documents may be mentioned by way of example.

WO 03/057607 A1 shows high-speed roll rollers for conveying strip material for use in the packaging industry. In particular, the aim is to improve the balancing of roll bodies. For this purpose, balancing bores which extend over the entire axial length of the roll are arranged within the roll body. The roll bodies shown therefore comprise additional material in order to be able to receive roll pins in recesses. In addition, the support of the roll body is of complicated design and prevents flexible mounting and dismounting of the roll body.

DE 2215342 A1 relates to antistatic and electrically conductive conveyor belt rolls for the paper-processing industry. Deformation of the conveyor belt roll is intended to be prevented by a rigid foam being arranged between metal shaft and cellular plastic. Since the rigid foam is electrically insulating, the metal shaft is preferably intended to be connected to the running surface covering by an electrically conductive wire connection or clamp. The arrangement and nature of the conveyor belt rolls prevents simplified handling, in particular in the event of an exchange of the conveyor belt rolls.

EP 1123887 A1 relates to a method for manufacturing paper conveyor belts for use in printers, fax machines and copying machines and therefore does not describe any roll rollers or roll feeds.

The prior art shown, however, discloses significant disadvantages. In particular, in conventional roll feeds, the rolls cannot be removed from the roll feed in a simplified manner by a bulky configuration and arrangement in connection with the roll feed. An exchange of rolls is thus associated with undesirably long downtimes of the roll feed, which makes the use of such rolls inefficient and uneconomical.

The object of the present invention is to at least partially overcome the aforementioned disadvantages. In particular, a roll and a roll feed are to be provided which at least partially overcome the disadvantages.

The roll should have a simplified construction and be simple and inexpensive to manufacture. In addition, a roll feed is to be provided which enables a simplified installation or an easy exchange of the roll(s).

DESCRIPTION OF THE INVENTION

These objects are achieved, at least partially, by a tube roll according to the invention, a roll feed and a method for manufacturing a tube roll according to the independent claims. Further aspects of the invention are set out in the dependent claims.

A 1. embodiment of the invention relates to a roll feed comprising: a base body; a first tube roll having a rolling surface; and a first bearing shaft; wherein the base body is configured to support the first tube roll and the first bearing shaft, wherein the first bearing shaft and the first tube roll are configured to be detachably connected to each other for a rotationally fixed connection, wherein the base body is configured such that the first tube roll can be removed from the base body in an axial direction, wherein the axial direction is substantially parallel to an axis of rotation of the first tube roll.

The tube roll (unless not particularly indicated, reference is made to the first tube roll) can have a radially circumferential rolling surface which is arranged between the two axial ends of the tube roll and is configured to come into contact with a workpiece. The rolling surface can be, in particular, a cylindrical rolling surface.

The workpiece which comes into contact with the rolling surface can be a band or strip material which is conveyed/fed by means of the tube roll. The conveying or feeding movement is transmitted from the tube roll to the workpiece via the rolling surface.

The base body is configured to support the first tube roll and the first bearing shaft.

For this purpose, the first tube roll can comprise a bearing surface which is configured to interact with a bearing in order to rotatably support the tube roll about an axis of rotation. The bearing surface can be configured, in particular, to interact with a rotary bearing, such as a plain bearing, a rolling bearing or the like. Furthermore, the base body can have a bearing in order to support the first bearing shaft. In one example, the base body can comprise a roll carrier (or rocker), wherein the bearing is located within the roll carrier in the mounted state. For example, the bearing can be installed in the roll carrier. Thus, the base body can support the first tube roll indirectly via the roll carrier.

The first bearing shaft and the first tube roll are configured to be detachably connected to each other for a rotationally fixed connection.

The detachable connection can be understood such that the first bearing shaft can be provided separately from the first tube roll and can be connected such that the first bearing shaft and the first tube roll rotate as a unit about the axis of rotation of the tube roll during operation of the roll feed. Thus, the first tube roll can be rotationally fixed to the first bearing shaft, for example during operation of the roll feed. During mounting/dismounting of the first tube roll, the connection can be released so that the first tube roll can be removed, preferably without having to remove further components, e.g. components of the first bearing shaft. The first bearing shaft is thus preferably further a component separate from the first tube roll. For releasing, advantageously only an axial removal of the first tube roll is required. In one example, the first tube roll can have a surface, preferably an inner surface and for example at least partially perpendicular to the circumferential direction of the first tube roll, which comes into contact with a driver which can be connected to the first bearing shaft. The driver can provide the connection between the first tube roll and the bearing shaft. Thus, the first tube roll can advantageously be configured integrally, in particular without a fixedly connected bearing shaft or a fixedly connected hub at a roll end. The first tube roll can be separated from the first bearing shaft in a simplified manner and can be pushed in and out axially from the base body and/or from the roll feed. This enables a simple mounting/dismounting of the first tube roll from the base body and/or from the roll feed. In this way, for example, a force fit can be provided between the first bearing shaft and the first tube roll in the circumferential direction for transmitting the rotational movement, wherein the first tube roll can further be separated from the first bearing shaft in the axial direction independently. For example, no shrinking or other force fit is required in the radial direction, as a result of which simple separation or releasing of the components in the axial direction would be prevented. Thus, any downtimes of the roll feed are reduced in the event of a exchange of the first tube roll. Thus, the roll feed enables an efficient and economical operation.

The base body can be formed in multiple pieces and can comprise a housing, for example. In particular, the base body can be configured such that the first tube roll can be removed from the base body in the axial direction. Here, the axial direction can be aligned substantially parallel to the axis of rotation of the first tube roll. Preferably, the axial direction substantially corresponds to the axis of rotation of the first tube roll. The first tube roll can preferably be removed to a side of the base body on which substantially no gear elements are located for transmitting movements to the first tube roll or away from the first tube roll.

For axial removal, the base body can have an installation opening, for example, through which the first tube roll can be inserted or removed axially. The installation opening can be closed with a cover, in particular a centered cover.

The first tube roll can have a hollow inner region in the region of the rolling surface, which has an inner diameter. The rolling surface and the hollow inner region can be arranged substantially concentrically (including manufacturing tolerances). In particular, the first tube roll can be produced from a tube which has a hollow inner region with an inner diameter. The inner diameter of the hollow inner region of the tube roll can correspond to the inner diameter of the hollow inner region of the tube, or the inner region of the tube roll can be reworked (for example by machining, grinding or other manufacturing methods), so that the inner diameter of the hollow inner region of the tube roll is greater than the inner diameter of the inner region of the tube.

The tube roll can have a wall thickness in the region of the rolling surface in the range of 3 mm to 15 mm, preferably in the range of 4 mm to 10 mm and particularly preferably in the range of 5 mm to 7 mm.

The tube from which the tube roll is produced can be a welded or a seamless tube. For example, the tube may have been produced by one of the following methods: extrusion, continuous casting, centrifugal casting, inclined rolling, plug rolling, stretch reducing, an impact bank method, a pilgering process method and/or the like. It is likewise possible for the tube to be a tube produced by machining.

A 2. embodiment relates to the preceding embodiment, wherein the roll feed further comprises a first driver to detachably connect the first bearing shaft to the first tube roll for a rotationally fixed connection, wherein the first driver preferably at least partially axially engages the first tube roll to contact a surface of the first tube roll which is substantially perpendicular to the circumferential direction of the first tube roll.

A driver can be a mechanical component which transmits the movement of one component to another component and thus entrains it. This is useful for a detachable connection. In one example, the first tube roll can have a notch, groove or the like. The driver can engage this notch, groove or the like when the first tube roll is in operation. In one example, the notch, groove or the like can have a surface which is aligned substantially perpendicular to the circumferential direction so that a force transmission between the first bearing shaft and the first tube roll is provided via the driver in the circumferential direction. The first driver can be connected to the bearing shaft, for example via a screw connection. In one example, the notch, groove or the like can be attached to the end of the first tube roll which is oriented towards the first bearing shaft. In one embodiment, the groove can be attached to two opposite sides of the end of the first tube roll oriented towards the first bearing shaft, preferably at an angular distance of approximately 170°-190°, more preferably 175°-185°, most preferably 180°.

With this arrangement, a force fit can be provided between the first bearing shaft and the first tube roll in the circumferential direction for transmitting the rotational movement. Advantageously, the first tube roll can still be released or separated from the first bearing shaft in the axial direction. For example, no shrinking or other force fit is required in the radial direction between the first bearing shaft or the first driver and the first tube roll. Otherwise, in one example, this could prevent simple releasing of the components. Thus, the roll feed enables an efficient and economical operation.

A 3. embodiment relates to one of the preceding embodiments, wherein the roll feed comprises a first bearing, wherein the first tube roll has a bearing surface, preferably an inner bearing surface, which is configured to interact with the first bearing.

The bearing surface of the first tube roll can be configured to interact with a rotary bearing, such as a plain bearing, a rolling bearing or the like. If the bearing surface interacts, for example, with a plain bearing, the bearing surface can have a corresponding surface quality in order to rotate radially in a plain bearing bushing of the plain bearing. If the bearing surface is intended to interact with a rolling bearing, the bearing surface can receive a bearing ring of the rolling bearing (for example in a form-fitting and/or force-fitting manner). The diameter of the bearing surface can be greater than or equal to the inner diameter of a hollow inner region of the first tube roll and smaller than or equal to the diameter of the rolling surface. The bearing surface can thus be formed integrally with the tube roll. For example, the bearing surface can be screwed onto the tube roll since the diameter of the first bearing surface (as seen in the radial direction) lies in the region of the wall thickness of the region in which the rolling surface is arranged. The bearing surface can also be produced by other production methods (for example by machining or grinding).

The bearing surface can in particular have a very large diameter in comparison with conventional rolls so that the risk of damage and/or overload fracture of the tube roll is minimized. An inner bearing offers the advantage that fewer dirt particles can enter the bearing from a workpiece and that a more compact construction is provided.

A 4. embodiment relates to the preceding embodiment, wherein the base body comprises a first centered cover which is configured to be detachably connected to the base body and to interact with the first bearing.

A cover can, in one example, constitute a mechanical component for closing an installation opening of the base body. The first tube roll can be inserted or removed axially through the installation opening. In addition, the centered cover can preferably comprise a bearing surface of the base body in order to interact with the first bearing which preferably supports the first tube roll. Further preferably, this bearing can be configured as an inner bearing of the first tube roll. Thus, a simple mounting/dismounting of the first tube roll can be achieved. For example, the first bearing shaft can be arranged at an end region of the first tube roll and the bearing surface of the first tube roll can be arranged at an opposite end region of the first tube roll in order to interact with the first bearing. In one example, the base body can comprise a roll carrier (or rocker), wherein the centered cover can be detachably connected to the base body via the roll carrier. For example, the centered cover is thus only indirectly connected to the base body. For example, the tube roll can be axially guided through the roll carrier (during installation) or axially removed (during dismounting). For this purpose, the roll carrier has a diameter which is greater than an outer diameter of the first tube roll, but furthermore has an upper limit in order to save material and costs. For example, the diameter of the roll carrier can be at most 150%, 130%, 120% or 110% of the outer diameter of the first tube roll.

A 5. embodiment relates to the preceding embodiment, wherein the first centered cover has a diameter which is at least 101%, preferably at least 102%, more preferably at least 105%, most preferably at least 110% of the length of an outer diameter of the first tube roll, and wherein the first centered cover has a diameter which is at most 150%, preferably at most 130%, more preferably at most 120%, most preferably at most 110% of the length of an outer diameter of the first tube roll, wherein the outer diameter of the first tube roll is preferably a maximum outer diameter.

The first centered cover can have a cylindrical shape at least in part. For example, a part of the first centered cover can be arranged in an outer wall of the base body, wherein this part has the shape of a cylinder. Advantageously, this cylinder has an outer diameter which is somewhat greater than the outer diameter of the first tube roll, so that the first tube roll can be removed through the resulting opening after removal of the first centered cover. The outer diameter of this cylinder should not be too large, since the centered cover otherwise becomes unnecessarily large, heavy and bulky.

A 6. embodiment relates to 4. or 5. embodiment, wherein the first centered cover is arranged on an outer side of the base body.

The outer side of the base body represents a connection from the inside of the roll feed or the base body to the environment. In this way, the first tube roll can be removed after removal of the first centered cover.

A 7. embodiment relates to any one of embodiments 4 to 6, wherein the first centered cover defines a transition from an axial end of the first tube roll through the base body to the environment.

A transition can be understood such that substantially only the first centered cover is located between the first tube roll and the environment. During operation, the centered cover is mounted, for example on the base body, and enables a support of the first tube roll at an axial end of the first tube roll.

An 8. embodiment relates to any one of embodiments 4 to 7, wherein the first centered cover is configured to allow free access from the environment to the first tube roll after release from the base body.

Free access can mean, for example, that the first tube roll can be removed and installed without being impaired or blocked by other components. Thus, for example, the first tube roll can be viewed and contacted from the environment when the first centered cover is released from the base body. For example, the first centered cover can be released and removed in order to remove and/or insert the first tube roll axially from the roll feed. Advantageously, extensive dismantling of the roll feed is not necessary for this purpose. The first centered cover can be fastened to the base body, for example, by means of screws.

Embodiments which Relate, Inter Alia, to the Second Tube Roll are Described Below With regard to the second tube roll, bearing shaft, centered cover, the second bearing, the second driver described below, the embodiments, features and advantages of the respective first component substantially apply.

A 9. embodiment relates to one of the preceding embodiments, wherein the roll feed comprises a second tube roll having a rolling surface, wherein the first and second tube rolls are arranged such that they are configured to convey a workpiece.

A 10. embodiment relates to the preceding embodiment, wherein the base body is configured to support the second tube roll, and wherein the base body is configured such that the second tube roll can be removed from the base body in an axial direction, wherein the axial direction is substantially parallel to an axis of rotation of the second tube roll.

A 11. embodiment relates to the 9. or 10. embodiment, wherein the roll feed comprises a second bearing shaft, wherein the second bearing shaft and the second tube roll are configured to be detachably connected to each other for a rotationally fixed connection, wherein the base body is configured to support the second bearing shaft, wherein the roll feed further comprises a second driver to detachably connect the second bearing shaft to the second tube roll for a rotationally fixed connection, wherein the second driver preferably at least partially axially engages the second tube roll to contact a surface of the second tube roll which is substantially perpendicular to the circumferential direction of the second tube roll.

A 12. embodiment relates to one of the embodiments 9 to 11, wherein the roll feed comprises a second bearing, wherein the second tube roll has a bearing surface, preferably an inner bearing surface, which is configured to interact with the second bearing.

A 13. embodiment relates to the preceding embodiment, wherein the base body comprises a second centered cover which is configured to be detachably connected to the base body and to interact with the second bearing.

A 14. embodiment relates to the preceding embodiment, wherein the second centered cover has a diameter which is at least 101%, preferably at least 102%, more preferably at least 105%, most preferably at least 110% of the length of an outer diameter of the second tube roll, and wherein the second centered cover has a diameter which is at most 150%, preferably at most 130%, more preferably at most 120%, most preferably at most 110% of the length of an outer diameter of the second tube roll, wherein the outer diameter of the second tube roll is preferably a maximum outer diameter.

A 15. embodiment relates to the 13. or 14. embodiment, wherein the second centered cover is arranged on an outer side of the base body.

A 16. embodiment relates to any one of embodiments 13 to 15, wherein the second centered cover defines a transition from an axial end of the second tube roll through the base body to the environment.

A 17. embodiment relates to any one of embodiments 13 to 16, wherein the second centered cover is configured to allow free access from the environment to the second tube roll after release from the base body.

Embodiments which Relate, Inter Alia, to the First and the Second Tube Roll are Described Below An 18. embodiment relates to one of the preceding embodiments, wherein the first and/or the second tube roll has only one bearing surface.

Only one bearing surface can mean that the tube roll has a single bearing surface. This reduces the complexity and simplifies the removal of the tube roll.

A 19. embodiment relates to one of the preceding embodiments, wherein the first and/or the second tube roll has a rolling surface having an outer diameter in the range of 20 mm to 200 mm, preferably in the range of 30 mm to 100 mm, more preferably in the range of 36 mm to 60 mm and most preferably in the range of 42 mm to 46 mm.

The outer diameter of the rolling surface of the first and/or the second tube roll can be understood as a maximum outer diameter.

A 20. embodiment relates to one of the preceding embodiments, wherein the first and/or the second tube roll has a rolling surface having an axial length in the range of 20 mm to 1000 mm, preferably in the range of 40 mm to 800 mm, more preferably in the range of 60 mm to 600 mm and most preferably in the range of 80 mm to 320 mm.

A 21. embodiment relates to one of the preceding embodiments, wherein the bearing surface of the first and/or second tube roll is respectively arranged within the axial extension of the rolling surface.

Within the axial extension of the rolling surface, it is to be understood that the bearing surface is located between the axial ends of the rolling surface. In one example, the rolling surface can extend over the entire axial length of the first/second tube roll and the bearing surface is located within this extension. This represents an advantageous and compact construction.

A 22. embodiment relates to one of the preceding embodiments, wherein the first and/or the second tube roll respectively has a hollow inner region, preferably respectively only one single and coherent hollow inner region.

Only one single, coherent hollow inner region can be understood such that there is no further hollow inner region of the first/second tube roll. This represents a constructively simple construction. In particular, a plurality of individual cavities separated from one another thus does not have to be provided, which is complex and constructively demanding.

A 23. embodiment relates to the preceding embodiment, wherein the hollow inner region of the first and/or the second tube roll respectively comprises in the axial direction a range of at least 70%, preferably at least 80%, more preferably at least 90%, most preferably at least 100% of the axial length of the rolling surface of the first and/or the second tube roll; and/or comprises in the radial direction a range of at least 60%, preferably at least 70%, more preferably at least 80%, even more preferably at least 90%, most preferably at least 95% of an outer diameter, over at least 70%, preferably at least 80%, more preferably at least 90%, most preferably at least 100% of the axial length of the rolling surface of the first and/or the second tube roll.

With this embodiment, the hollow inner region can extend between 70% and 100% of the axial length of the first/second tube roll. Thus, the construction and the complexity of the tube rolls can be reduced meaningfully.

In the radial direction, the hollow inner region of the tube rolls extends over a range up to a diameter of 95% of an outer diameter of the tube rolls. If, in one example, the diameter of the tube rolls is 100 mm, then the hollow inner region would most preferably extend to at least 95 mm so that the hollow inner region has a radius of 47.5 mm and is configured concentrically with the tube roll. In this way, material can be saved meaningfully and at the same time a required strength of the tube roll can be ensured. The extension over the radial region should be present at least over a certain axial length of the tube roll. Preferably, the extension should be present over 100% of the axial length of the tube roll.

A 24. embodiment relates to one of the preceding embodiments, wherein the rolling surface of the first and/or the second tube roll is configured radially circumferentially and integrally with the first and/or the second tube roll; the tube roll substantially has one layer, preferably has only one single layer, wherein at least one further layer is arranged in the region of the rolling surface; and/or the first and/or the second tube roll substantially consists of metal, preferably of at least 80%, more preferably at least 90%, even more preferably of at least 95%, most preferably of at least 99% metal.

An integral configuration of the rolling surface with the tube roll can mean that the tube roll is configured integrally, so that the tube roll could be produced from one component. This simplifies the manufacture. A single layer of the tube roll likewise requires a simplified manufacture. In some cases, the tube roll could also have a special processing in the region of the rolling surface. Thus, the rolling surface could have a finer or particularly different surface condition than other regions of the tube roll. This offers the advantage that targeted, and economically relevant regions of the tube roll are processed. The processing of the surface could in some cases optionally also comprise an application of a material.

A 25. embodiment relates to one of the preceding embodiments, wherein the first and/or the second tube roll is configured to be mounted and/or operated without an axially continuous and internally disposed component, in particular an axle, shaft or spindle.

An operation without a continuous and internally disposed component can be understood such that substantially no component is located within the tube roll when the tube roll is mounted and/or in operation. In particular, in this way no component which extends over at least 30%, 40%, 50% or more of the axial length of the tube roll is located within the tube roll. Thus, for example, no inner axle, shaft, spindle or the like is located within the tube roll. Thus, the construction of the roll feed is simplified, and the complexity is reduced. Moreover, the access from the outside is considerably simplified. In addition, the visibility and accessibility of other components is increased. For example, an inner bearing which interacts with the tube roll could be better inspected and more accessible.

A 26. embodiment relates to one of the preceding embodiments, insofar as they also relate to the 9. embodiment, wherein the roll feed comprises an electric motor which can be coupled to the roll feed in order to drive at least the second tube roll, and wherein the roll feed comprises a gear arrangement, and wherein a first gear element is associated with the first tube roll and a second gear element is associated with the second tube roll, and wherein a rotational movement of the second tube roll is transmitted via the second gear element to the first gear element and then to the first tube roll.

The electric motor can also be another type of motor which is suitable for driving. The electric motor can be part of the roll feed or can be coupled to the roll feed in order to drive it. For example, the roll feed is configured such that at least the second tube roll can be driven. It is likewise possible to drive the first tube roll or a plurality of tube rolls of the roll feed actively, i.e. with motors. The gear elements can comprise gearwheels, for example. Furthermore, these can be rotationally fixed to the first/second bearing shaft, for example, in order to transmit a rotational movement.

BRIEF DESCRIPTION OF THE FIGURES

The accompanying figures are briefly described below.

DETAILED DESCRIPTION OF THE FIGURES

Figure 1:
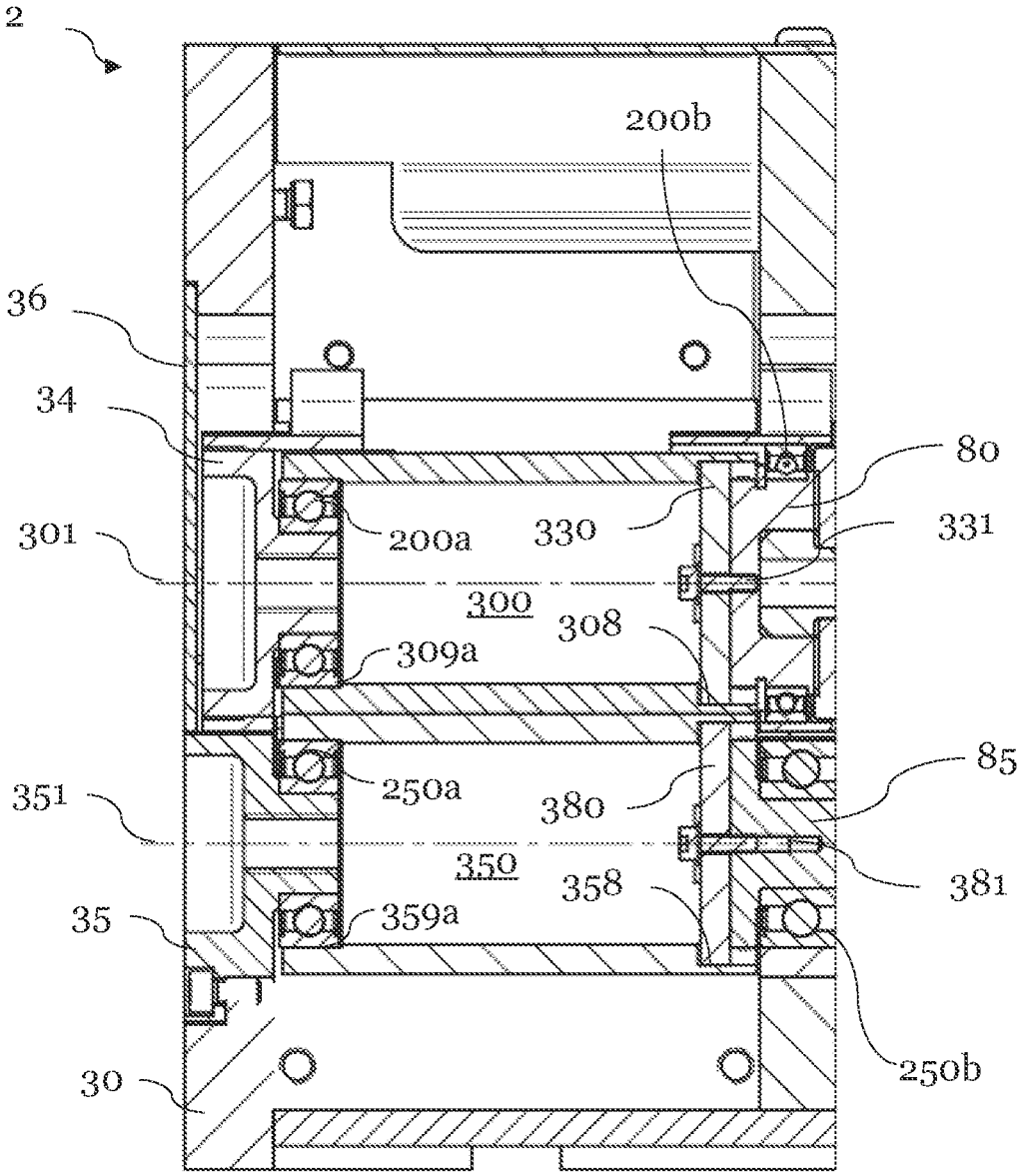
FIG. 1 shows a schematic representation of a roll feed according to the invention.

FIG. 1 shows a schematic representation of a roll feed 2 according to the invention. In the roll feed 2 shown, two rolls 300, 350 are formed as tube rolls. The tube rolls can be understood as the first tube roll 300 and second tube roll 350 according to the invention. The roll feed also comprises a base body 30 which can consist of a plurality of components and can contain a housing, for example. An electric motor (not shown) drives the lower roll 350 via a drive shaft which is at the same time a bearing shaft 85.

The tube rolls 300, 350 each have a bearing surface 309*a*, 359*a* which interact with a bearing 200*a*, 250*a* in order to rotatably support the tube rolls 300, 350 about an axis of rotation 301, 351. The bearing surfaces of the tube rolls are arranged at a first end of the tube roll and are designed as inner bearing surfaces. At the second end, which is opposite the first end, the tube roll 300 comprises a receptacle 308 which can receive a bearing shaft 80 in a rotationally fixed manner with a detachable connection. The bearing shaft 80 is supported on the bearing 200*b* and is connected via a roll coupling 90 (not shown) to a gear element 21 (not shown). At the second end, which is opposite the first end, the tube roll 350 comprises a receptacle 358 which can receive a bearing shaft 85 in a rotationally fixed manner with a detachable connection. The bearing shaft 85 is supported on the bearing 250*b* and is connected to an electric motor for driving the roll 350. In addition, a gear element 22 (not shown) is received in a rotationally fixed manner on the bearing shaft 85 and engages with the gear element 21 (not shown) in order to also drive the tube roll 300.

With the receptacle 308, the bearing shaft 80 is received in a rotationally fixed manner by the tube roll 300 in a detachable connection by means of a driver 330. The connection between the driver 330 and the tube roll 300 is detachable so that the tube roll 300 can be easily separated from the driver 330. For example, when mounting/dismounting the tube roll 300 into or out of the base body 30 of the roll feed 2, the tube roll 300 can be easily removed axially. The driver 330 represents the connection between the tube roll 300 and the bearing shaft 80. The driver 330 is connected to the bearing shaft 80 via a connecting element 331, for example a screw. Thus, advantageously a rotationally fixed connection between the tube roll 300 and the bearing shaft 80 can be provided which is detachable via the driver 330. In particular, the driver 330 can contact the tube roll 300 at a surface 307 of a groove 306 (shown in FIG. 3) of the tube roll 300. Here, the surface 307 of the groove 306 can be aligned perpendicular to the circumferential direction so that an effective force transmission between the bearing shaft 80 and the tube roll 300 is provided via the driver 330.

The tube roll 300 can thus be configured integrally without a fixedly connected bearing shaft or a fixedly connected hub at the tube roll end. This enables a simple mounting/dismounting of the tube roll 300 from the roll feed 2. Namely, the tube roll 300 can be easily separated from the bearing shaft by the driver 330, thus pulled off axially and then pushed in and out axially from the roll feed 2.

The bearings 200*a*, 250*a* are respectively received on bearing surfaces of the base body 30 of the roll feed 2. As described below with reference to FIG. 2, the bearings 200*a*, 250*a* are in particular respectively received on bearing surfaces of centered cover 34, 35 comprised by the base body 30. The centered cover 34, 35 is detachably connected to the base body 30. In one example, the bearing 200*a* is indirectly connected to the base body 30.

The embodiments relating to the first tube roll 300 and the first bearing shaft 80 likewise apply to the second tube roll 350 and the second bearing shaft 85, even if this is not explicitly mentioned. This likewise relates to the driver 380 and the connecting element 381.

Figure 2:
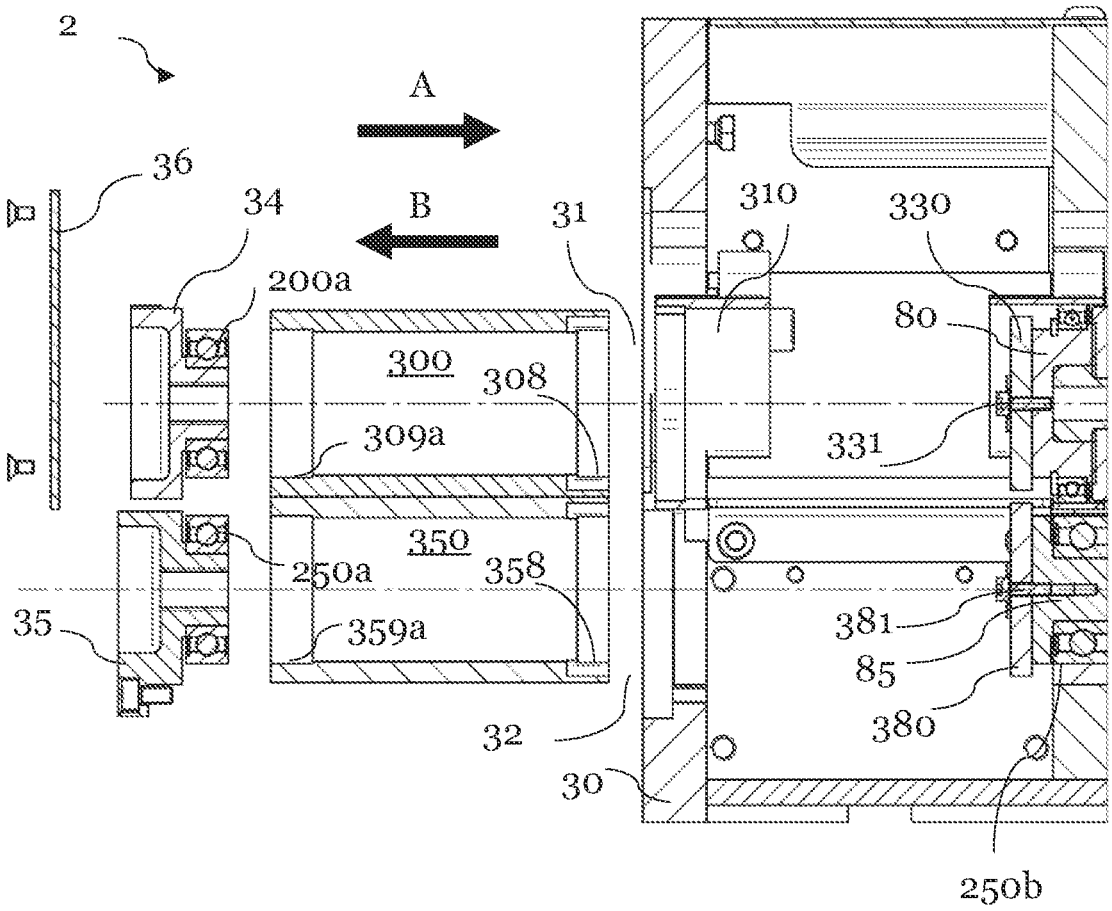
FIG. 2 shows a schematic representation of a roll feed according to the invention during assembly/dismantling.

FIG. 2 shows a schematic representation of the roll feed according to the invention of the previous figure during assembly/dismantling. The simplified mounting/dismounting of the tube rolls from the roll feed 2 is illustrated. The base body 30 is formed in multiple pieces and comprises a housing. In particular, the base body 30 of the roll feed 2 is configured such that the tube rolls 300, 350 can be installed in the base body 30 in the axial direction (direction A) or removed therefrom (direction B). For this purpose, the base body 30 has at least one installation opening 31. In the embodiment shown, the base body 30 has two installation openings 31, 32. The roll 300 can be inserted (direction A) or removed (direction B) axially through a first installation opening 31. The roll 350 can be inserted (direction A) or removed (direction B) axially through a second installation opening 32. The installation openings are respectively closed with a cover, in particular a centered cover 34, 35, wherein the centered cover 34, 35 comprises a bearing surface of the base body 30 for the bearings 200*a*, 250*a*. Thus, a simple mounting/dismounting of the tube rolls can be achieved. In one example, a hood 36 can be comprised by the roll feed, which constitutes a lateral boundary of the base body 30 and is arranged, for example, at a side end of the base body 30. The base body 30 also comprises a roll carrier (or rocker) 310 (shown in FIG. 2 only on the left side of the base body 30, but also present on the right side), wherein the bearing 200*a* is located within the roll carrier 310 in the mounted state. In this way, the bearing 200*a* is indirectly connected to the base body.

The tube rolls could be mounted or dismounted one after the other or at the same time. For example, reference is made to the tube roll 300. Assembly of a tube roll 300 can also be referred to as installation of a tube roll 300. Dismantling of a tube roll 300 can also be referred to as dismounting of a tube roll 300. Advantageously, during assembly/dismantling, the entire roll feed 2 or the entire base body 30 of the roll feed 2 does not have to be disassembled. This is enabled, for example, by the arrangement of the bearing shaft 80, the driver 330 and the connecting element 331, so that the tube roll can be detachably connected to these components and does not have to be configured integrally with the tube roll 300.

The centered cover 34 is arranged on the left side of the base body 30 of the roll feed 2 and enables a simple removal of the tube roll 300, wherein the construction of the base body 30 remains substantially unchanged during removal. Conventional roll feeds do not have such an installation opening 31 and/or centered cover 34, since simplified axial mounting/dismounting is ruled out because of the multipiece and fixedly connected construction of the conventional tube rolls. The centered cover 34 can be removed, for example, to the left side (in FIG. 2) of the base body 30. If a hood 36 is present, it can be removed before removal of the centered cover 34. When the centered cover 34 is removed, the installation opening 31 is no longer closed. The installation opening 31 only needs to have a diameter which is greater than the outer diameter of the tube roll 300. In this way, the tube roll 300 can be removed and installed through the installation opening 31 in a minimally invasive manner. Minimally invasive can be understood to mean that a low effort is required for this purpose, there is a low influence on other components of the roll feed 2 and/or a low movement of other components of the roll feed 2 is necessary in order to carry out the exchange of the tube roll 300. In the event of wear of the tube roll 300 or a damaged tube roll 300, a new tube roll 300 can be installed in this way simply, quickly and with low effort.

Thus, the intervention in the ongoing operation of the roll feed is minimized in comparison with conventional tube rolls and the downtimes of the roll feed 2 are substantially reduced. This increases the efficiency and economy of the entire roll feed 2.

In one example, the diameters of the bearing shafts can be configured to be large, so that lower forces act on the material in the event of a torque transmission. This increases the durability of the components. In particular, in this way, roll fractures can occur less frequently in the event of overloading and the tube roll 300 can remain substantially undamaged. This is also enabled by the integral construction detachable from the bearing shaft, so that in the event of damage to the bearing shaft, the bearing shaft can be replaced without having to replace the tube roll. In conventional roll feeds, the entire construction of rolls with fixedly connected bearing shafts would have to be replaced.

Figure 3:
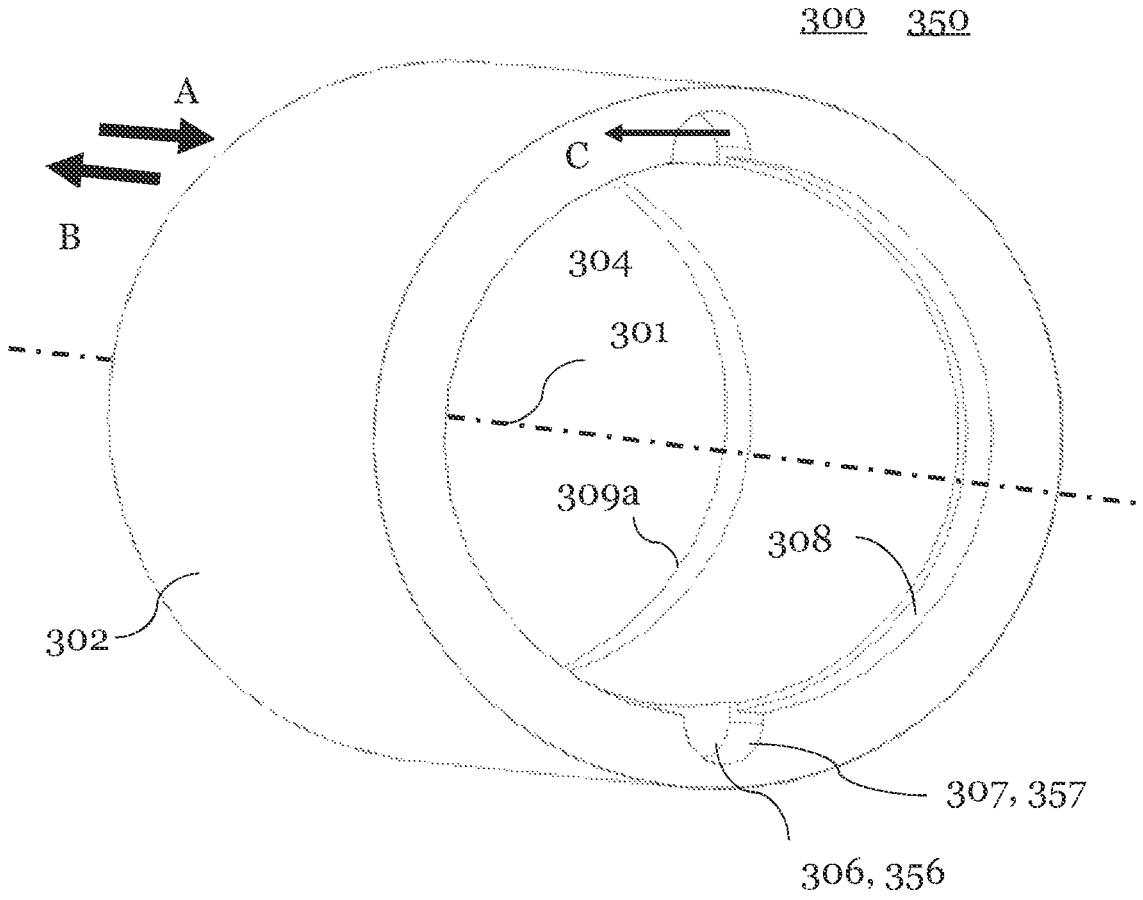
FIG. 3 shows a schematic representation of a tube roll according to the invention (first and/or second tube roll)

FIG. 3 shows a schematic representation of the tube rolls 300, 350 according to the invention of the previous figures. Without explicit reference, the embodiment of the first tube roll substantially also applies to the second tube roll. A surface 307 of a groove 306 is shown in the region of the receptacle 308 of the tube roll 300. The driver 330 (FIGS. 1, 2) is adapted in shape to the groove 306 and contacts the surface 307 during operation of the roll feed 2. The groove 306 can be understood as a notch, recess or the like in the tube roll 300. Here, the surface 307 of the groove 306 can be aligned perpendicular to the circumferential direction so that an effective force transmission between the bearing shaft 80 and the tube roll 300 is provided via the driver 330. If the surface 306 of the groove 307 is aligned perpendicular to the circumferential direction, this means that a normal of the surface 306 points in the circumferential direction, characterized by arrow C in FIG. 3. A force fit is thus provided by a surface of the driver wedge 332 (see FIG. 4) of the driver 330 and the surface 307 of the groove 306 lying flat on one another. The driver wedge 332 is arranged at the ends of the driver 330 and is configured such that it engages the groove 306 when the tube roll 300 is inserted axially. The driver 330 has two ends and has a driver wedge 332 at both ends. The groove 306 is attached to two opposite sides, in particular at an angular distance of 180°, of the end of the first tube roll 300 oriented towards the first bearing shaft 80. A rotational movement of the tube roll 300 can thus be transmitted to the bearing shaft 80 by the contact of the surfaces in the circumferential direction. A rotational movement of the bearing shaft 80 can also be transmitted to the tube roll 300 in this way. In this way, for example for transmitting a rotational movement, it is not absolutely necessary that a force fit is provided in the radial direction between the driver 330 or the bearing shaft 80 and the tube roll 300. As already described above, the second tube roll 350 likewise has a groove 356 and a surface 357, wherein a driver 380 engages the groove 356 of the second tube roll 350 with a driver wedge 382 at both ends of the driver 380 when the tube roll 350 is inserted axially. The tube roll furthermore has a rolling surface 302 and a hollow inner region 304. The receptacle 308 enables, inter alia, a centering of the tube roll 300 on the bearing shaft 80.

Figure 4:
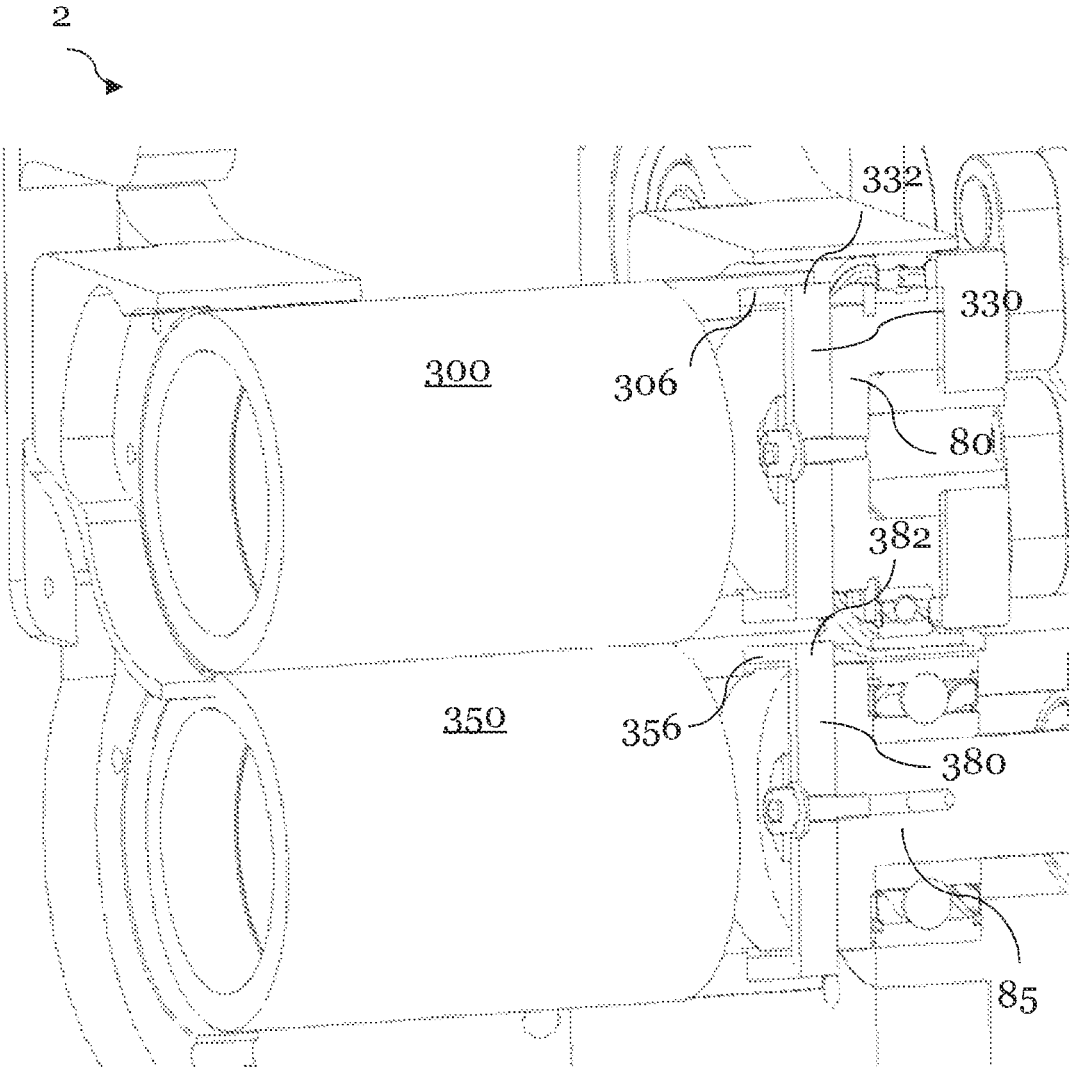
FIG. 4 shows a schematic representation of a roll feed according to the invention during partial assembly/dismantling.

FIG. 4 shows a schematic representation of the roll feed according to the invention of the previous figures during partial assembly/dismantling of the tube rolls 300, 350. The ends of the tube rolls 300, 350 oriented towards the bearing shafts 80, 85 are shown in part in a cross-sectional view, to illustrate engagement of the drivers 330, 380. The remaining region of the tube rolls, towards the opposite end, is shown in a full view, thus not in a cross-sectional view. The two tube rolls are partially pulled out axially and their ends oriented towards the bearing shafts are located axially close to the position of the drivers 330, 380. This figure illustrates the axial engagement of the driver wedges 332, 382 in the grooves 306, 356 of the tube rolls. When the driver wedges 332, 382 engage with the grooves 306, 356 of the tube rolls, a transmission of the rotational movement of the tube rolls to the bearing shafts and/or vice versa can take place in the circumferential direction. In particular, in this way a force fit can be provided in the circumferential direction, wherein the components (drivers and tube rolls) can nevertheless be separated from one another in the axial direction. For example, no shrinking or other force fit is required in the radial direction between the bearing shafts/drivers and the tube rolls, which would prevent simple separation of the components in the axial direction.

Figure 5:
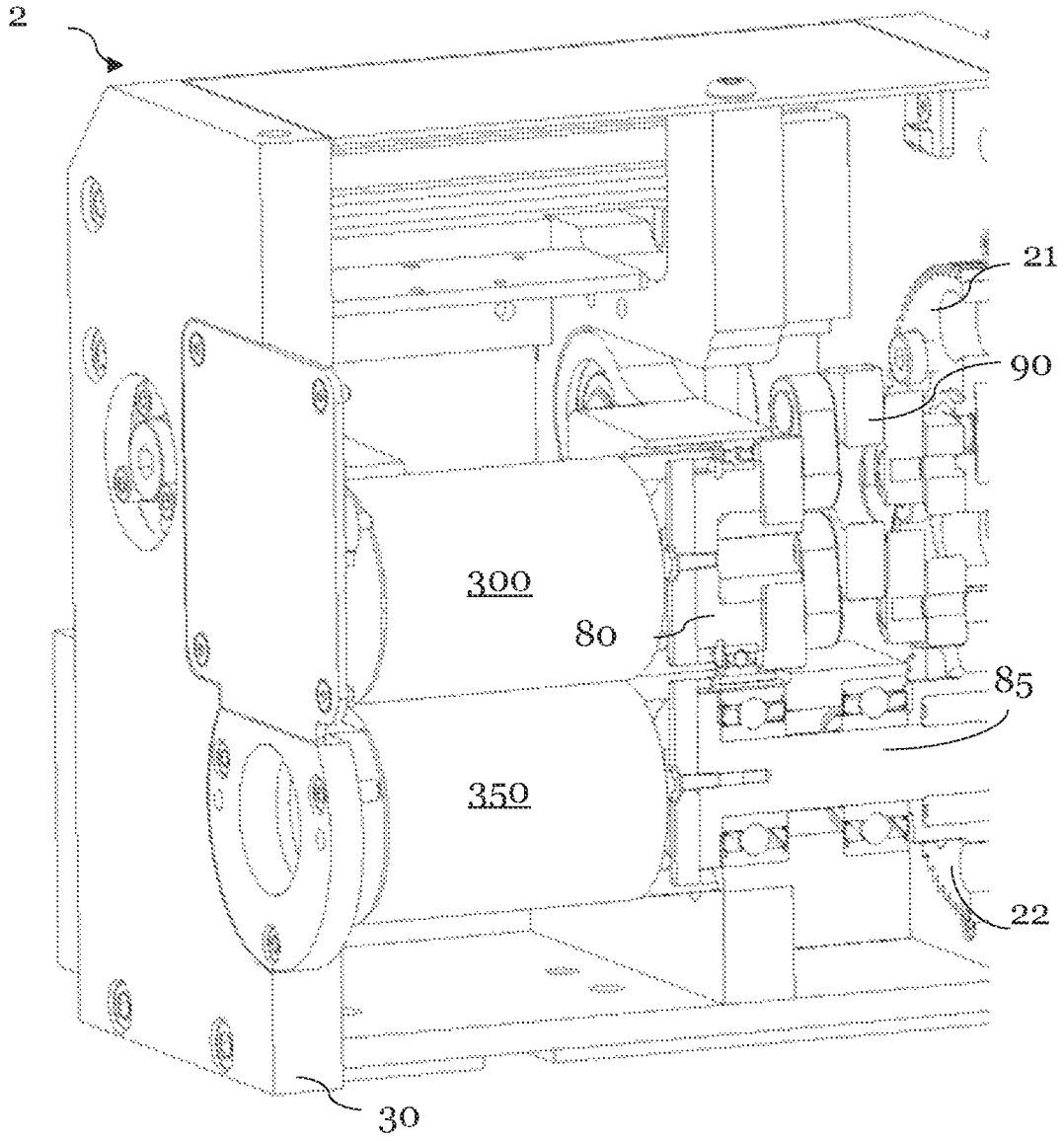
FIG. 5 shows a schematic representation of a roll feed according to the invention in an enlarged view.

FIG. 5 shows a schematic representation of the roll feed according to the invention of the previous figures in an enlarged view. The first tube roll 300 and the second tube roll 350 are shown. Furthermore, the first bearing shaft 80 is shown, which is connected via the roll coupling 90 to the gear element 21. In addition, the second bearing shaft 85 is shown, which is connected to an electric motor for driving the second tube roll 350. In addition, a gear element 22 is received in a rotationally fixed manner on the first bearing shaft 85 and engages with the gear element 21 in order to also drive the first tube roll 300.

Figure 6:
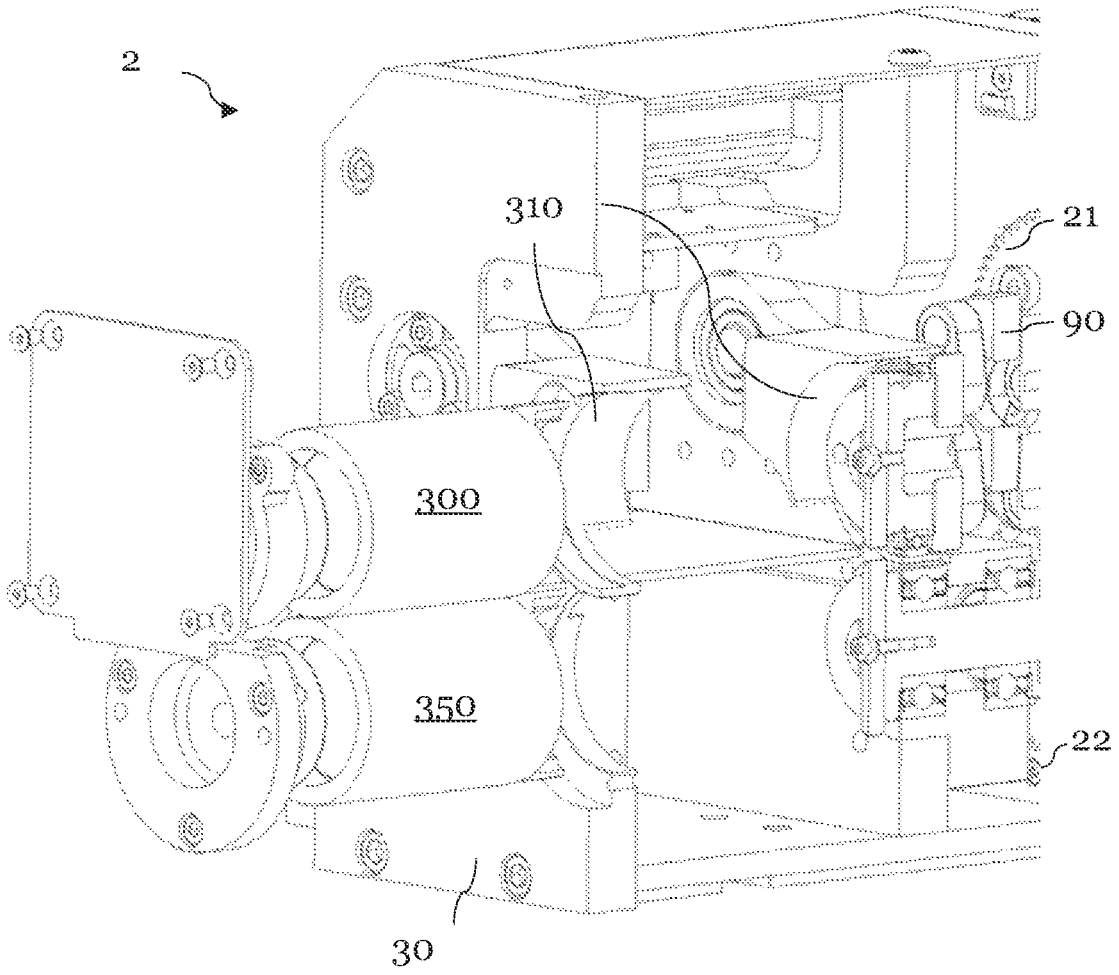
FIG. 6 shows a schematic representation of a roll feed according to the invention during assembly/dismantling in an enlarged view.

FIG. 6 shows a schematic representation of the roll feed according to the invention of the previous figures during assembly/dismantling in an enlarged view. Here, the tube rolls 300 and 350 are removed from the roll feed 2. The base body 30 of the roll feed 2 also comprises a roll carrier 310. The diameter of the roll carrier 310 is configured such that the tube roll can be guided through in a space-saving manner during dismantling/assembly.

What is claimed is:

1. A roll feed comprising:

a base body;

a first tube roll having a rolling surface;

a first bearing shaft; and a first driver to detachably connect the first bearing shaft to the first tube roll for a rotationally fixed connection, wherein the base body is configured to support the first tube roll and the first bearing shaft, wherein the first bearing shaft and the first tube roll are configured to be detachably connected to each other for a rotationally fixed connection, wherein the base body is configured such that the first tube roll can be removed from the base body in an axial direction, wherein the axial direction is substantially parallel to an axis of rotation of the first tube roll, wherein the roll feed comprises a first bearing, wherein the first tube roll has a bearing surface which is configured to interact with the first bearing.

2. The roll feed according to claim 1, wherein the first driver at least partially axially engages the first tube roll to contact a surface of the first tube roll which is substantially perpendicular to the circumferential direction of the first tube roll.

3. The roll feed according to claim 2, wherein the base body comprises a first centered cover which is configured to be detachably connected to the base body and to interact with the first bearing.

4. The roll feed according to claim 3, wherein the first centered cover has a diameter which is at least 101% of the length of an outer diameter of the first tube roll, and wherein the first centered cover has a diameter which is at most 150% of the length of an outer diameter of the first tube roll, wherein the outer diameter of the first tube roll is preferably a maximum outer diameter.

5. The roll feed according to claim 3, wherein the first centered cover is arranged on an outer side of the base body.

6. The roll feed according to claim 3, wherein the first centered cover defines a transition from an axial end of the first tube roll through the base body to the environment.

7. The roll feed according to claim 3, wherein the first centered cover is configured to allow free access from the environment to the first tube roll after release from the base body.

8. The roll feed according to claim 1, wherein the roll feed comprises a second tube roll having a rolling surface, wherein the first and second tube rolls are arranged such that they are configured to convey a workpiece.

9. The roll feed according to claim 8, wherein the base body is configured to support the second tube roll, and wherein the base body is configured such that the second tube roll can be removed from the base body in an axial direction, wherein the axial direction is substantially parallel to an axis of rotation of the second tube roll.

10. The roll feed according to claim 9, wherein the roll feed comprises a second bearing shaft, wherein the second bearing shaft and the second tube roll are configured to be detachably connected to each other for a rotationally fixed connection, wherein the base body is configured to support the second bearing shaft, wherein the roll feed further comprises a second driver to detachably connect the second bearing shaft to the second tube roll for a rotationally fixed connection, wherein the second driver at least partially axially engages the second tube roll to contact a surface of the second tube roll which is substantially perpendicular to the circumferential direction of the second tube roll.

11. The roll feed according to claim 8, wherein the roll feed comprises a second bearing, wherein the second tube roll has a bearing surface, an inner bearing surface, which is configured to interact with the second bearing.

12. The roll feed according to claim 11, wherein the base body comprises a second centered cover which is configured to be detachably connected to the base body and to interact with the second bearing.

13. The roll feed according to claim 12, wherein the second centered cover has a diameter which is at least 101% of the length of an outer diameter of the second tube roll, and wherein the second centered cover has a diameter which is at most 150% of the length of an outer diameter of the second tube roll, wherein the outer diameter of the second tube roll is a maximum outer diameter.

14. The roll feed according to claim 13, wherein the second centered cover is arranged on an outer side of the base body.

15. The roll feed according to claim 14, wherein the second centered cover defines a transition from an axial end of the second tube roll through the base body to the environment.

16. The roll feed according to claim 15, wherein the second centered cover is configured to allow free access from the environment to the second tube roll after release from the base body.

17. The roll feed according to claim 16, wherein at least one of the first and the second tube roll has only one bearing surface.

18. The roll feed according to claim 17, wherein at least one of the first and the second tube roll has a rolling surface having an outer diameter in the range of 20 mm to 200 mm.

19. The roll feed according to claim 18, wherein at least one of the first and the second tube roll has a rolling surface having an axial length in the range of 20 mm to 1000 mm.

20. The roll feed according to claim 19, wherein the bearing surface of at least one of the first and the second tube roll respectively is arranged within the axial extension of the rolling surface.

21. The roll feed according to claim 20, wherein at least one of the first and the second tube roll has a hollow inner region that forms one single and coherent hollow inner region.

22. The roll feed according to claim 21, wherein the hollow inner region of at least one of the first and the second tube roll comprises in the axial direction a range of at least 70%, of the axial length of the rolling surface of at least one of the first and the second tube roll; and comprises in the radial direction a range of at least 60% of an outer diameter, over at least 70% of the axial length of the rolling surface of the first and/or the second tube roll.

23. The roll feed according to claim 22, wherein the rolling surface of at least one of the first and the second tube roll is configured radially circumferential and integrally with at least one of the first and the second tube roll and has one layer that is one single layer, wherein at least one further layer is arranged in the region of the rolling surface; and at least one of the first and the second tube roll substantially consists of metal, being made of at least 80% metal.

24. The roll feed according to claim 22, wherein at least one of the the first and the second tube roll is configured to be mounted and operated without an axially continuous and internally disposed component, in particular an axle, shaft or spindle.

25. The roll feed according to claim 8, wherein the roll feed comprises an electric motor which can be coupled to the roll feed in order to drive at least the second tube roll, and wherein the roll feed comprises a gear arrangement, and wherein a first gear element is associated with the first tube roll and a second gear element is associated with the second tube roll, and wherein a rotational movement of the second tube roll is transmitted via the second gear element to the first gear element and then to the first tube roll.

* * * * *